US007234255B2

(12) United States Patent
Peng et al.

(10) Patent No.: US 7,234,255 B2
(45) Date of Patent: Jun. 26, 2007

(54) FLAME IMITATION DEVICE FOR WALL MOUNTED HEATER

(75) Inventors: Weidong Peng, Foshan (CN); Xinnan Yuan, Foshan (CN); Haifeng Sun, Foshan (CN); Yuannan Zhang, Foshan (CN)

(73) Assignee: Guangdong Midea Electric Appliances, Co., Ltd., Foshan (CN)

( * ) Notice: Subject to any disclaimer, the term of this patent is extended or adjusted under 35 U.S.C. 154(b) by 30 days.

(21) Appl. No.: 11/294,244

(22) Filed: Dec. 5, 2005

(65) Prior Publication Data

US 2006/0156596 A1 Jul. 20, 2006

(30) Foreign Application Priority Data

Dec. 6, 2004 (CN) ..... 2004 2 0102028

(51) Int. Cl.
*G09F 19/00* (2006.01)

(52) U.S. Cl. ..... 40/428; 431/125

(58) Field of Classification Search ..... 40/428, 40/430, 431; 392/348; 126/512; 431/125
See application file for complete search history.

(56) References Cited

U.S. PATENT DOCUMENTS

| | | | | |
|---|---|---|---|---|
| 1,214,863 | A * | 2/1917 | Woeste | 359/851 |
| 1,747,556 | A * | 2/1930 | Price | 40/431 |
| 2,684,244 | A * | 7/1954 | Brooks | 40/428 |
| 3,006,251 | A * | 10/1961 | Wells | 359/522 |
| 6,615,519 | B2 * | 9/2003 | Hess | 40/428 |

FOREIGN PATENT DOCUMENTS

| | | |
|---|---|---|
| CA | 2175442 | 10/1997 |
| CN | 01-113160 | 6/2001 |
| EP | 1 271 060 | 1/2003 |
| GB | 2 298 073 | 8/1996 |

* cited by examiner

*Primary Examiner*—Cassandra Davis
(74) *Attorney, Agent, or Firm*—Connolly Bove Lodge & Hutz LLP

(57) ABSTRACT

The invention relates to a flame imitation device for a wall-mounted heater. The flame imitation device comprises a light source, a combustion bed including imitated firewood and embers, and a vertical translucent screen located closely adjacent to the back edge of the combustion bed. The light source is located under the combustion bed. A glittering member is rotatably provided behind the translucent screen. The main body of the glittering member comprises a polyhedron with a polygonal cross section. A reflector is provided on the polyhedron. The glittering member is connected to a rotational driver. Light irradiated from the light source partially transmits upward onto the combustion bed for imitating firewood and embers. Light irradiated from the light source partially transmitted rearward to the glittering member positioned at the back portion of the heater, and reflects the light to the translucent screen. With the rotation of the glittering member, a dynamic flame image presents on the translucent screen. The structure and manufacturing process of the flame imitation device of the invention are simple. Moreover, the reflectors are arranged over the whole polyhedron which results in that the flame images produced by reflecting lights are continuous and the imitation effects are more vivid.

11 Claims, 2 Drawing Sheets

FLAME IMITATION DEVICE FOR WALL MOUNTED HEATER

FIELD OF THE INVENTION

The invention relates to a member of a wall-mounted heater and, more specifically, to a flame imitation device for a wall-mounted heater. It is an improvement in a wall-mounted heater of the prior art.

DESCRIPTION OF THE PRIOR ART

Wall-mounted heaters are very popular currently because they provide vivid flame effects as the same time as they send out heat during use, without any cost and trouble, such as emitting exhaust gas, in relation with real flames. Meanwhile, wall-mounted gas heaters, although emit exhaust gas, have some advantages over wall-mounted heaters which burn real firewood. To imitate flames created in combustion, flame imitation devices have been developed. For example, a flame imitation device disclosed in Chinese Patent CN01113160 entitled "a flame imitation device for electric heater" comprises a dynamic light source, i.e. a glittering member, a flame-shaped wall on which various flame-shaped transparent apertures are formed, a translucent screen for imaging, a translucent glass screen with a glazed surface, and plastic blocks in the form of firewood and embers. A dynamic light source is constructed by the following way. Firstly, an opaque plate is carved to form randomly arranged transparent apertures therethrough. Then, the upper edge and lower edge of the opaque plate are connected to each other to form a cylinder, and a light source is attached inside the cylinder. Finally, the cylinder is attached to a rotational driver. A flame image in combustion presents on the translucent screen by the irradiation of the dynamic light source. A drawback of the dynamic light source of this invention is that the flame images are not continuous because the transparent apertures are scattered over the cylinder and the portions of the cylinder other than the apertures are opaque. Further, the light source is located inside the cylinder, so its structure and manufacturing process are complicate and costly.

Canada Patent CA2175442 and United Kingdom Patent GB2298073 also disclose some similar flame imitation devices, and they have the similar drawbacks, i.e. the structure and manufacturing process of the glittering member are complicate and costly, and the flame images are non-continuous, etc.

SUMMARY OF THE INVENTION

In order to overcome the known problems associated with the flame imitation device of the prior art, the present invention provides a flame imitation device for a wall-mounted heater, in which the structure and manufacturing process of the glittering member are simple and cost-efficient, the flame images are continuous, and the imitation effects are more vivid.

To achieve the above-mentioned objects, the invention provides a flame imitation device for a wall-mounted heater. The flame imitation device comprises a light source, a combustion bed including imitated firewood and embers, and a vertical translucent screen located closely adjacent to the back edge of the combustion bed. The light source is located under the combustion bed. A glittering member is rotatably provided behind the translucent screen. The main body of the glittering member comprises a polyhedron with a polygonal cross section. A reflector is provided on the polyhedron. The glittering member is connected to a rotational driver.

Preferably, the polyhedron of said glittering member is formed from a regular hexagonal prism, which is twisted about its center axis so as to provide a predetermined helix angle, and the reflector is made from an elongated reflecting sheet.

Preferably, said polyhedron is in solid form, and the reflector is arranged over the outer surface of the polyhedron.

Preferably, said polyhedron is in hollow form, and the reflector is arranged over the outer surface of the polyhedron.

Preferably, the polyhedron is carved so as to be formed with helical cavities, and the reflector is arranged over the inner surface of the polyhedron.

Preferably, said rotational driver is an electric motor.

Preferably, a vertical flame-shaped wall is arranged between the glittering member and the translucent screen, and flame-shaped transparent areas are carved through the wall.

Preferably, said combustion bed is made from translucent materials.

Preferably, the back surface of said translucent screen is a scattering surface.

The invention has the following advantages over the prior art. The glittering member comprises a polyhedron with a polygonal cross section and a reflector provided on the polyhedron, and the structure and manufacturing process of the glittering member are simple. Moreover, the reflectors are arranged over the whole polyhedron which results in that the flame images produced by reflecting lights are continuous and the imitation effects are more vivid.

PREFERRED EMBODIMENTS OF THE INVENTION

Now the preferred embodiments of the invention will be described with reference to the drawings.

Embodiment 1

Figure 1:
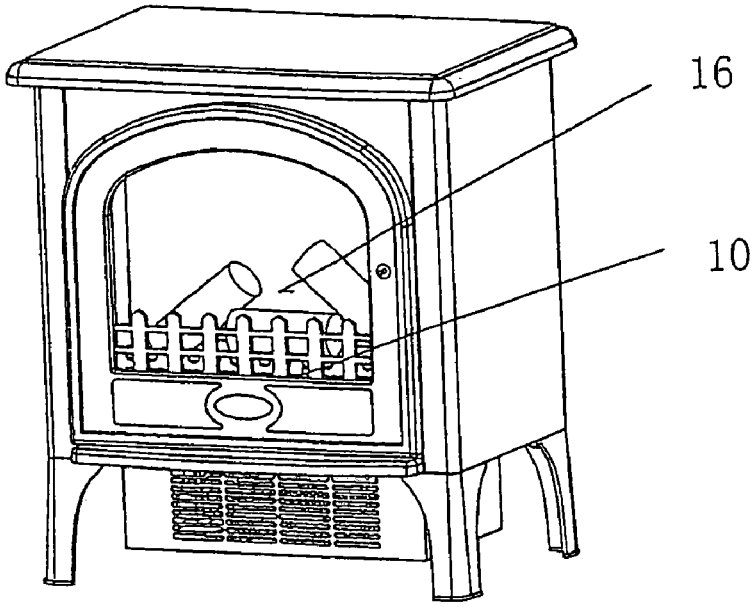
FIG. 1 shows a front view of wall-mounted heater including the flame imitation device according the invention.
Figure 2:
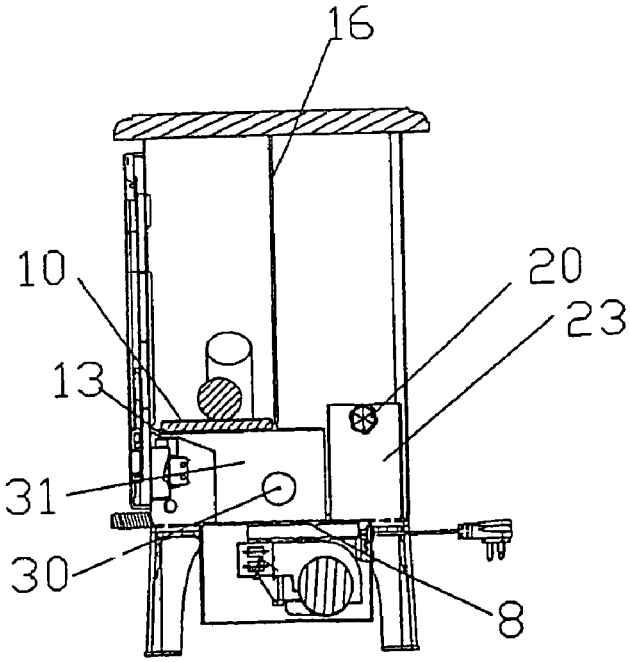
FIG. 2 shows a side section view of a first embodiment of the invention.
Figure 3:
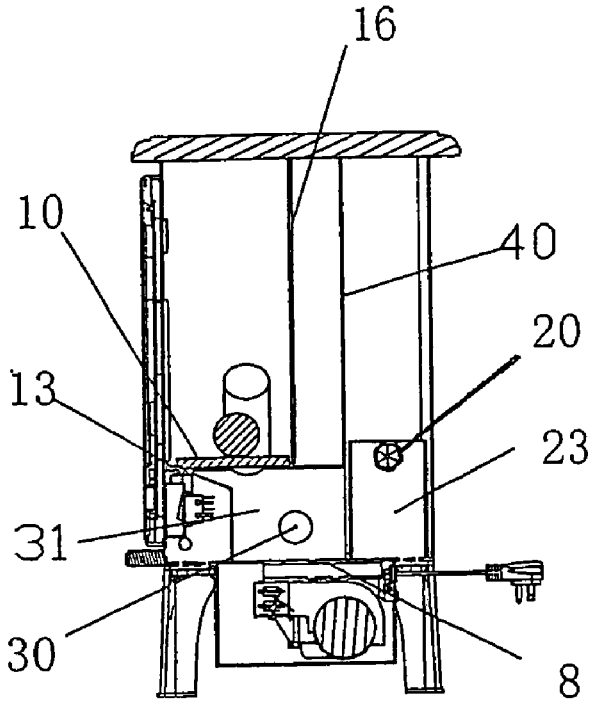
FIG. 3 shows a side section view of a second embodiment of the invention.

According to the invention, a flame imitation device for a wall-mounted heater comprises a light source 30, a combustion bed 10 including imitated firewood and embers, and a vertical translucent screen 16, as shown in FIGS. 1 and 2. The light source 30 is located under the combustion bed 10 and is fixed onto a supporting member 31 of the heater. The supporting member 31 is fixed onto a bottom plate 8 of the housing of the heater. Light irradiated from the light source 30 partially transmits upward onto the combustion bed 10. The combustion bed 10 is molded from translucent plastic or resin, or other translucent materials. Then, the molded combustion bed 10 is coated with colors for imitating firewood and embers. Then, when the light permeates through the combustion bed 10, an imitating effect that firewood and embers are burning can be realized. In use, the combustion bed 10 may be directly fixed onto the supporting member 31.

Figure 4:
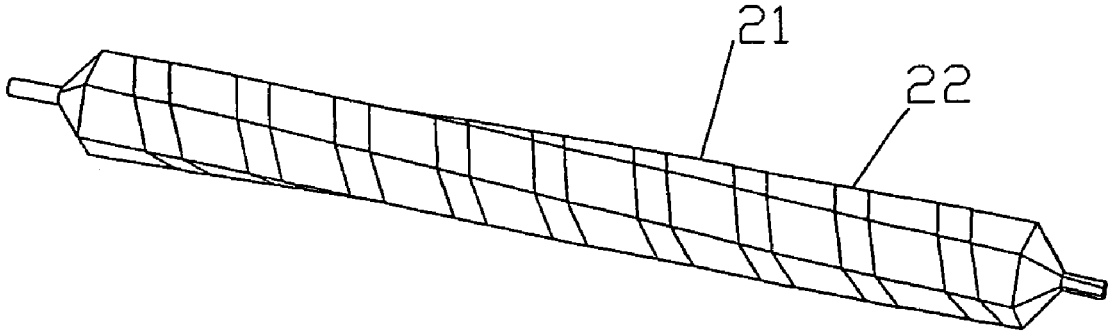
FIG. 4 schematically shows the glittering member of the flame imitation device of the invention.

Alternatively, the combustion bed 10 may be fixed onto a frame 13 which is provided between the combustion bed 10 and the supporting member 31. The translucent screen 16 is arranged closely adjacent to the back edge of the combustion bed 10. A glittering member 20 is rotatably provided behind the translucent screen 16. The glittering member 20 is supported by two supporting members 23 fixed onto the bottom plate 8 of the heater. An electric motor or other driver is connected to one of the supporting members 23 to rotationally drive the glittering member 20. The glittering member 20 comprises two parts, wherein one part is a polyhedron 21 and the other part is a reflector 22, as shown in FIG. 4. In a preferred embodiment, the polyhedron 21 is formed from a regular hexagonal prism which is twisted about its center axis so as to provide a predetermined helix angle. After being twisted, the center axis maintains unchanged, and each of its cross section taken in a plane perpendicular to the center axis is still a regular hexagon. The top surface and the bottom surface of the regular hexagonal prism are removed such that the regular hexagonal prism is formed as a hollow case. The polyhedron 21 is made from plastic by blow molding, or the polyhedron 21 is made from a metal plate. At least one reflector 22 is provided on or in the polyhedron 21. Preferably, the reflector 22 is an elongated reflecting sheet which can be affixed onto the surface of the polyhedron 21. The reflector 22 is affixed to the surface of the polyhedron along a helix path with a helix angle different from the helix angle of the prism. With the rotation of the polyhedron 21, the light irradiating to the translucent screen 16 continuously varies, and thus providing an effect similar to a dynamic flame.

The polyhedron 21 may also be in the form of other regular polygon prisms. The polyhedron 21 may be twisted, or alternatively, not twisted. The polyhedron 21 may be carved so as to be formed with helical cavities, and a reflector 22 of a block form may be arranged onto the inner surface of the polyhedron 21. The polyhedron 21 may also be in solid form made from plastic or other suitable materials. In this case, the reflector 22 is arranged on the outer surface of the polyhedron 21.

The reflector 22 is made from light reflecting material such as metal foils, plastic sheets, or pieces of glass with a glazed surface, or the like. The reflector 22 can be made from other material with reflective property. The reflective surface of the reflector 22 is silvery, red, orange or yellow colored. Thus, the light irradiated from the light source 30 is partially transmitted rearward to the glittering member 20 positioned at the back portion of the heater. The glittering member 20 reflects the light in a dynamic way to the translucent screen 16. The translucent screen 16 is made from translucent plastic or other translucent materials, and its back surface is a scattering surface. With the rotation of the glittering member 20, a dynamic flame image presents on the translucent screen 16. Since the translucent screen 16 is located closely adjacent to the back edge of the combustion bed 10, the flame image on the translucent screen 16 seems to be generated by the combustion bed 10.

Embodiment 2

The structure of embodiment 2 is about the same as that of embodiment 1, except that a vertical flame-shaped wall 40 is arranged between the glittering member 20 and the translucent screen 16. The wall 40 is made from a metal plate or other opaque materials, and it is carved to form flame-shaped transparent areas thereon. The light reflected by the glittering member 20 permeates through the transparent areas to form a dynamic flame-shaped light beams. The beams transmit through the translucent screen 16, so as to provide a more vivid imitation effect.

The invention is suitable to use in a wall-mounted electrical heater or a wall-mounted gas heater to get vivid effects.

The invention claimed is:

1. A flame imitation device for a wall-mounted heater, comprising: a light source, a combustion bed including imitated firewood and embers, and a vertical translucent screen located closely adjacent to a back edge of the combustion bed, said flame imitation device being characterized in that the light source is located under the combustion bed, and a glittering member is rotatably provided behind the translucent screen, wherein the main body of the glittering member comprises a polyhedron formed from a regular hexagonal prism, which is twisted about its center axis so as to provide a helix angle and a reflector is provided on the polyhedron, and wherein the glittering member is connected to a rotational driver.

2. The flame imitation device for a wall-mounted heater as defined in claim 1, characterized in that the reflector is made from an elongated reflecting sheet.

3. The flame imitation device for a wall-mounted heater as defined in claim 1, characterized in that said polyhedron is in solid form, and the reflector is arranged over the outer surface of the polyhedron.

4. The flame imitation device for a wall-mounted heater as defined in claim 1, characterized in that said polyhedron is in hollow form, and the reflector is arranged over the outer surface of the polyhedron.

5. The flame imitation device for a wall-mounted heater as defined in claim 1, characterized in that said polyhedron is in hollow form, and the reflector is arranged over the outer surface of the polyhedron.

6. The flame imitation device for a wall-mounted heater as defined in claim 1, characterized in that said polyhedron is in hollow form, and the reflector is arranged over the outer surface of the polyhedron.

7. The flame imitation device for a wall-mounted heater as defined in claim 1, characterized in that the polyhedron is in hollow form and the reflector is arranged over the inner surface of the polyhedron.

8. The flame imitation device for a wall-mounted heater as defined in claim 1, characterized in that said rotational driver is an electric motor.

9. The flame imitation device for a wall-mounted heater as defined in claim 8, characterized in that a vertical flame-shaped wall is arranged between the glittering member and the translucent screen, and flame-shaped transparent areas are formed by carving through the wall.

10. The flame imitation device for a wall-mounted heater as defined in claim 9, characterized in that said combustion bed is made from translucent materials.

11. The flame imitation device for a wall-mounted heater as defined in claim 10, characterized in that the translucent screen has a front surface and a back surface and the back surface of said translucent screen is a scattering surface.

* * * * *